US007176423B2

(12) United States Patent
Kataoka et al.

(10) Patent No.: US 7,176,423 B2
(45) Date of Patent: Feb. 13, 2007

(54) INDUCTION HEATING APPARATUS

(75) Inventors: Akira Kataoka, Sanda (JP); Izuo Hirota, Toyonaka (JP); Katsuyuki Aihara, Akashi (JP); Nobuyoshi Makio, Miki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/521,876

(22) PCT Filed: Aug. 1, 2003

(86) PCT No.: PCT/JP03/09844

§ 371 (c)(1),
(2), (4) Date: Jan. 21, 2005

(87) PCT Pub. No.: WO2004/016047

PCT Pub. Date: Feb. 19, 2004

(65) Prior Publication Data

US 2005/0274717 A1 Dec. 15, 2005

(30) Foreign Application Priority Data

Aug. 7, 2002 (JP) ..... 2002-229761

(51) Int. Cl.
*H05B 6/12* (2006.01)

(52) U.S. Cl. ..... 219/622; 219/620

(58) Field of Classification Search ..... 219/622, 219/620, 618, 600, 623, 647; *H05B 6/12*
See application file for complete search history.

(56) References Cited

U.S. PATENT DOCUMENTS 5,070,222 A * 12/1991 Yahav et al. ..... 219/621
5,369,249 A 11/1994 Kwon
5,866,884 A * 2/1999 Cornec et al. ..... 219/622
6,080,975 A * 6/2000 Kuse et al. ..... 219/622
6,384,387 B1 * 5/2002 Owens et al. ..... 219/601
6,555,799 B2 * 4/2003 Owens et al. ..... 219/622
6,861,628 B2 * 3/2005 Owens et al. ..... 219/622
6,989,517 B2 * 1/2006 Owens et al. ..... 219/622

(Continued)

FOREIGN PATENT DOCUMENTS

JP 52-64699 A 5/1977

(Continued)

*Primary Examiner*—Daniel Robinson
(74) *Attorney, Agent, or Firm*—Akin Gump Strauss Hauer & Feld, LLP

(57) ABSTRACT

An induction heating apparatus wherein an electrostatic shield and the low-potential portion of an inverter circuit are electrically connected securely is provided. The induction heating apparatus in accordance with the present invention comprises a top plate 11 on which a matter 14 to be heated is placed, an induction heating coil 12 for induction heating the matter 14 to be heated, driving means 19 for driving the induction heating coil 12, and a stationary plate 15 and a cover for stationary plate 18 provided between the matter 14 to be heated and the induction heating coil 12, wherein connection portions 17*a* each integrated with a connection terminal 17 are electrically connected to the electrostatic shield 16 provided on the stationary plate 15 using a conductive adhesive, and the connection parts are held between the stationary plate 15 and the cover for stationary plate 18. With this configuration, the connection parts can be held securely and stably.

1 Claim, 9 Drawing Sheets

U.S. PATENT DOCUMENTS 7,009,159 B2 * 3/2006 Kataoka et al. ..... 219/622

FOREIGN PATENT DOCUMENTS

| | | | |
|---|---|---|---|
| JP | 56-49089 | | 5/1981 |
| JP | 61-27087 | A | 2/1986 |
| JP | 61-183524 | U | 11/1986 |
| JP | 63-18791 | U | 2/1988 |
| JP | 5-87824 | U | 11/1993 |
| JP | 6-5357 | A | 1/1994 |
| JP | 7-14669 | A | 1/1995 |

* cited by examiner

INDUCTION HEATING APPARATUS

CROSS-REFERENCE TO RELATED APPLICATION

This application is a Section 371 of International Application No. PCT/JP03/09844, filed Aug. 1, 2003, which was published in the Japanese language on Feb. 19, 2004, under International Publication No. WO 2004/016047 A1, the disclosure of which is incorporated herein by reference.

TECHNICAL FIELD

The present invention relates to an induction heating apparatus provided with an electrostatic shield between a matter to be heated and an induction heating coil.

BACKGROUND ART

Conventionally, as this kind of induction heating apparatus, for example, the apparatus described in Japanese Laid-open Patent Application No. Sho 61-16491 was available. FIG. 9 is a view showing the equivalent circuit of the induction heating coil and its peripheral portion in this kind of conventional induction heating apparatus.

The configuration of the conventional induction heating apparatus will be elucidated below using FIG. 9. In FIG. 9, numeral 1 designates a top plate; an induction heating coil 2 is provided below the top plate 1; and a matter 3 to be heated is placed thereon. Numeral 4 designates an electrostatic shield applied to the bottom face of the top plate 1 and electrically connected to the low-potential portion of an inverter circuit (not shown) for driving the induction heating coil 2 via the electrode 4*a* of the electrostatic shield 4. As the equivalent circuit of the peripheral portion, the equivalent capacitance C1 between the induction heating coil 2 and the electrostatic shield 4, the equivalent capacitance C2 between the matter 3 to be heated and the electrostatic shield 4, the equivalent resistance R1 of a human body at the time when the human body makes contact with the matter 3 to be heated, and the resistance R2 of the electrostatic shield 4 are shown.

In this configuration, when the matter 3 to be heated has low magnetic permeability and is a pan made of aluminum, copper, etc. having a low resistance, the frequency of the current flowing through the induction heating coil 2 is high in comparison with the case when the matter 3 to be heated is an iron pan, that is, a matter having high magnetic permeability and relatively large resistivity and being liable to generate Joule heat; hence, the peak voltage applied to the induction heating coil 2 becomes 1 kV or more.

In the case that the electrostatic shield 4 exists and is electrically connected to the low-potential portion as described above, the potential difference between the matter 3 to be heated and the electrostatic shield 4 becomes small, whereby a leak current at the time when a human body makes contact with the matter 3 to be heated is decreased significantly. Hence, safety is ensured even if the human body makes contact with the matter 3 to be heated.

When the electrostatic shield 4 is electrically connected to the low-potential portion of the inverter circuit for driving the induction heating coil 2, a method wherein one end of a lead wire serving as the connection path thereof is connected to the electrode 4*a* of the electrostatic shield 4 applied to the top plate 1 by soldering or by contacting an elastic member, such as a spring, to which the one end of the lead wire is connected, and the other end of the lead wire is connected to the low-potential portion of the inverter circuit has been used generally.

However, in the case of the above-mentioned conventional configuration, the strength of the connection between the electrode 4*a* and the lead wire or the stability and reliability of the connection are insufficient; for example, because of some reasons, such as the occurrence of a tension force during a production process, reduction in the strength of solder owing to the heat from the matter 3 to be heated during cooking and the vibration or drop impact of the apparatus, the lead wire may be disconnected from the electrode 4*a*, the spring terminal may be oxidized, the contact part between the electrostatic shield and the spring terminal is separated owing to vibration or the like, whereby there is a fear of causing a problem of increasing the contact resistance and preventing the function of the electrostatic shield 4 from performing sufficiently.

In order to solve the above-mentioned conventional problem, the present invention is intended to provide an induction heating apparatus capable of ensuring the electrical connection between the electrostatic shield and the low-potential portion of the inverter circuit and allowing the function of the electrostatic shield to perform sufficiently at all times.

DISCLOSURE OF THE INVENTION

In order to solve the above-mentioned conventional problem, an induction heating apparatus in accordance with the present invention has a configuration wherein a stationary plate having electrical insulation is provided between a top plate and an induction heating coil, and the stationary plate is provided with an electrostatic shield and connection portions for connecting the electrostatic shield to a low-potential portion. Hence, production is facilitated and the influence of the high temperature of a matter to be heated on the electrostatic shield is relieved in comparison with the conventional method wherein the top plate is provided with the electrostatic shield. In addition, since, unlike the top plate, the stationary plate is not a component constituting the outer shell, it has freedom in the selection of shape and matter, and the connection between the electrostatic shield and the connection portions can have a stable configuration, whereby it is possible to ensure inexpensively connection with high reliability less susceptible to the influences of vibration of the apparatus, drop impact of the apparatus, etc.

Figure 2:
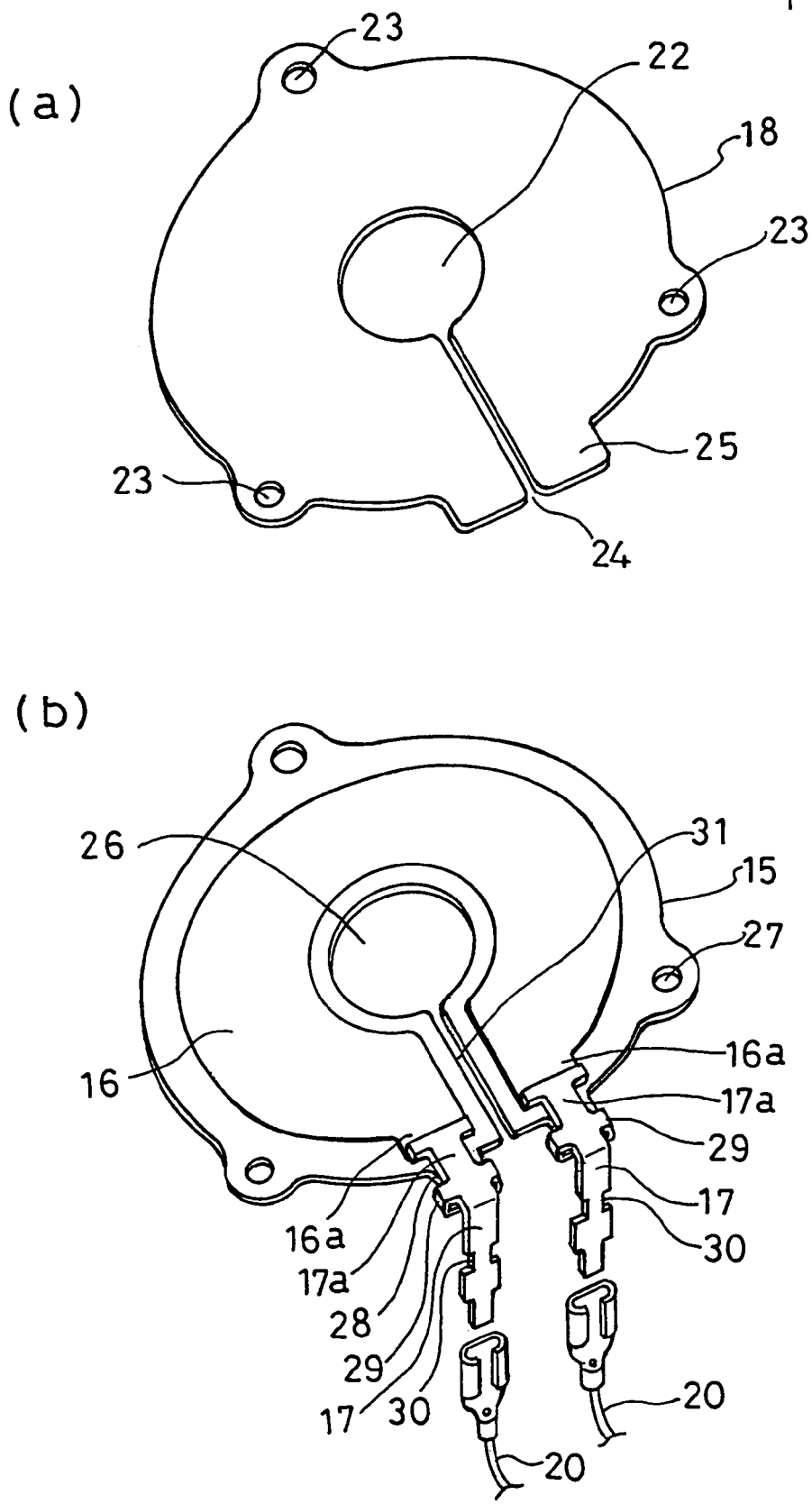
Figure 3:
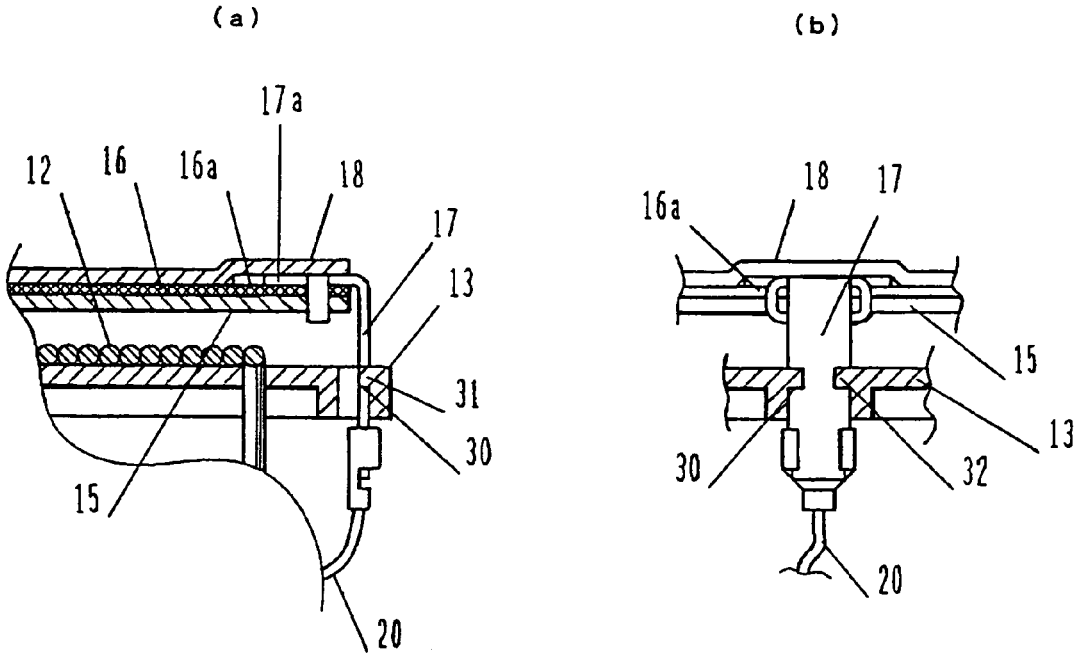
Figure 4:
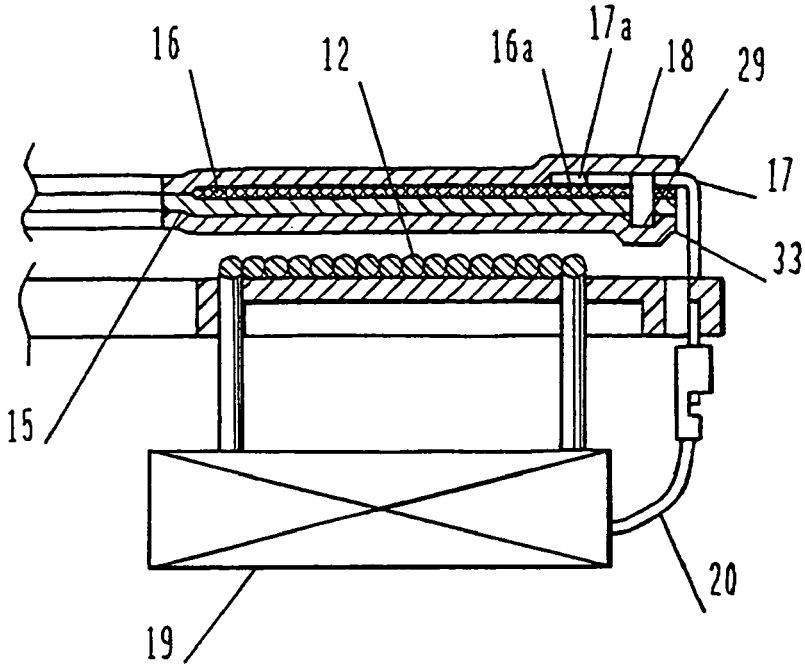
Figure 5:
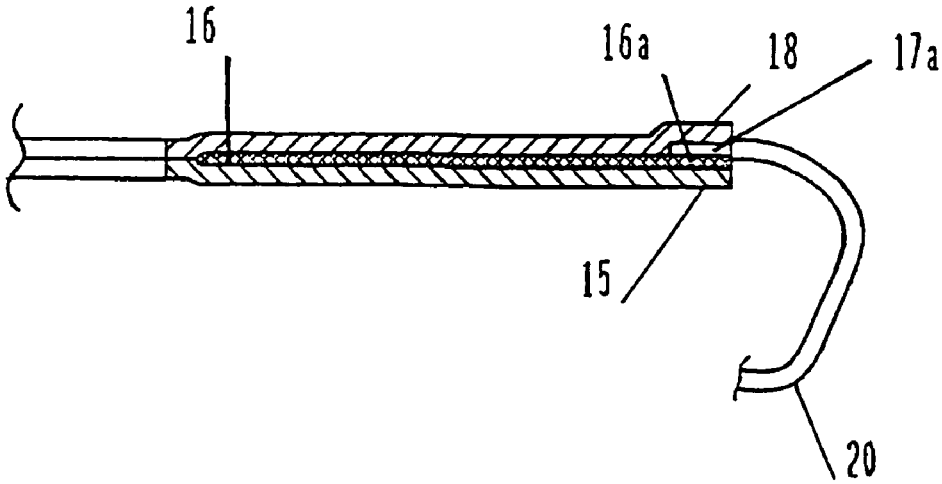
Figure 6:
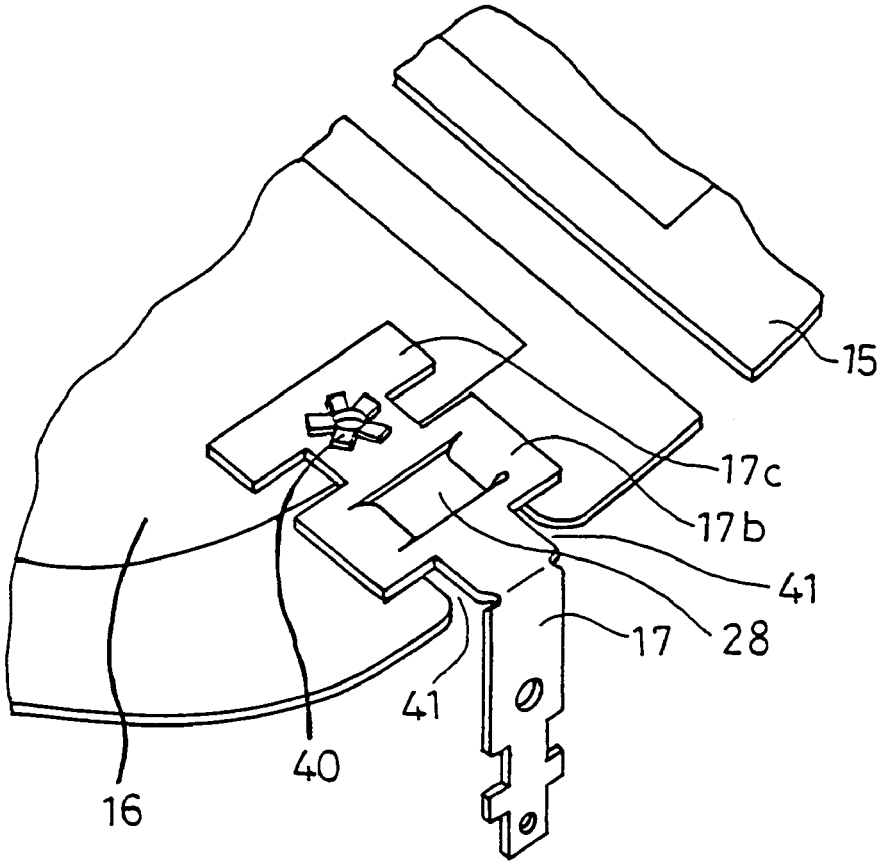
Figure 7:
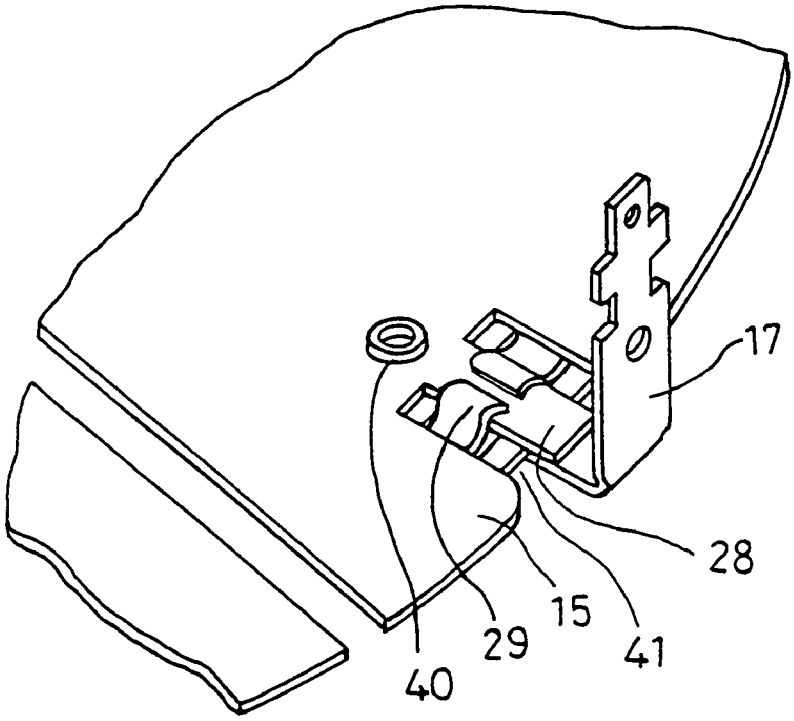
Figure 8:
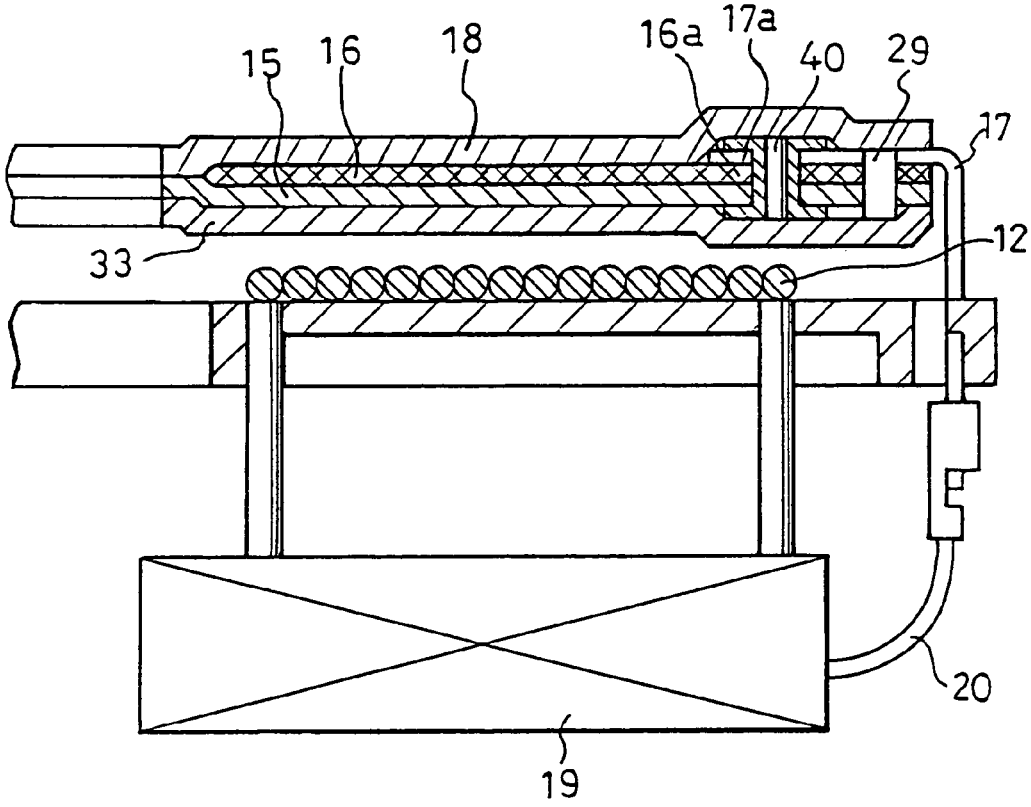
Figure 9:
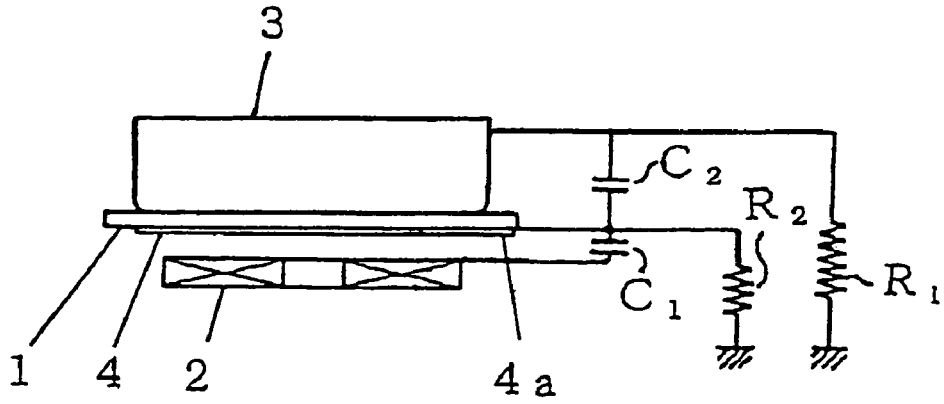

Part (a) of FIG. 2 is a perspective view showing the cover for stationary plate of the induction heating apparatus in accordance with Embodiment 1 of the present invention, and part (b) of FIG. 2 is a perspective view showing the stationary plate of the induction heating apparatus;

Part (a) of FIG. 3 is a cross-sectional view (a cross-sectional view from the front) showing the main section of a configuration wherein a connection terminal of the induction heating apparatus in accordance with Embodiment 1 of the present invention is installed to the induction heating coil, and part (b) of FIG. 3 is a cross-sectional view showing the main section from the right;

FIG. 4 is a cross-sectional view showing the insulation configuration of the connection terminal of the induction heating apparatus in accordance with Embodiment 1 of the present invention;

FIG. 5 is a cross-sectional view showing the connection between the electrostatic shield and a lead wire of the induction heating apparatus in accordance with Embodiment 1 of the present invention;

FIG. 6 is a magnified perspective view showing the main section in the vicinity of the connection portion of the connection terminal, viewed from the side of the top plate, in an induction heating apparatus in accordance with Embodiment 2 of the present invention;

FIG. 7 is a magnified perspective view showing the main section in the vicinity of the connection portion of the connection terminal, viewed from the side of the induction heating coil, in the induction heating apparatus in accordance with Embodiment 2 of the present invention;

FIG. 8 is a cross-sectional view showing the main section in the vicinity of the connection portion of the connection terminal in the induction heating apparatus in accordance with Embodiment 2 of the present invention; and FIG. 9 is a cross-sectional view showing the configuration the conventional induction heating apparatus.

BEST MODE FOR CARRYING OUT THE INVENTION

An induction heating apparatus in accordance with an aspect of the present invention comprises an induction heating coil for induction heating a matter to be heated, a top plate provided between the above-mentioned matter to be heated and the above-mentioned heating coil, driving means for supplying a high-frequency current to the above-mentioned induction heating coil, and an electrostatic shield having conductivity, provided between the above-mentioned top plate and the above-mentioned induction heating coil and connected to the low-potential portion of the above-mentioned driving means directly or via an impedance, wherein a stationary plate having electrical insulation is provided between the above-mentioned top plate and the above-mentioned induction heating coil, the above-mentioned stationary plate is provided with the above-mentioned electrostatic shield and connection portions connected to the above-mentioned electrostatic shield, and the above-mentioned electrostatic shield is connected to the above-mentioned low-potential portion via the above-mentioned connection portions.

With this configuration, since the electrostatic shield having conductivity, provided between the top plate and the induction heating coil and connected to the low-potential portion (a portion having a potential lower than that of the high-potential portion of the heating coil, for example, a power supply voltage to be input, a DC voltage after the rectification thereof or a potential close thereto) is provided, the electrostatic coupling between the high-voltage portion generated in the heating coil and the matter to be heated is decreased, and the high-frequency high voltage generated in the heating coil is applied to the body of the user via stray capacitance between the heating coil and the matter to be heated, whereby leak current flowing in the body of the user can be suppressed.

Since the stationary plate having electrical insulation is provided between the top plate and the induction heating coil and the stationary plate is provided with the electrostatic shield and the connection portions for connecting the electrostatic shield to the low-potential portion, production is facilitated and also the influence of the high temperature of the matter to be heated on the electrostatic shield is relieved in comparison with the conventional method wherein the electrostatic shield and the connection portions are formed on the rear face of the top plate. In addition, since, unlike the top plate, the stationary plate is not a component constituting the outer shell, it has freedom in the selection of shape and matter, and the connection between the electrostatic shield and the connection portions can have a stable configuration, whereby it is possible to ensure highly reliable connection which is less susceptible to the influences of vibration of the apparatus, drop impact of the apparatus, etc.

Since the connection portions are separate from the top plate, the assembly work of the apparatus is facilitated. In addition, the connection portions can have various forms in accordance with circumstances, for example, a form using a method wherein a connector is connected to one end of each lead wire and the other end is connected to the electrostatic shield, and a form using a method wherein connection terminals are directly connected to the electrostatic shield.

In the above-mentioned induction heating apparatus in accordance with another aspect of the present invention, since the connection portions are firmly secured and electrically connected to the electrostatic shield in a state wherein the connection points are made stationary by soldering, bonding, pressure welding, etc., the electrical connection between the electrostatic shield and the connection portions is strengthened and stabilized.

In the above-mentioned induction heating apparatus in accordance with another aspect of the present invention, since the connection portion is integrated with a connection terminal that can be connected to and disconnected from a connection wire and the above-mentioned connection terminal is configured so as to be secured to the stationary plate, the configuration for playing two roles, that is, the reliable electrical connection to the electrostatic shield and the facilitation of the connection to and disconnection from the electrostatic shield, is simplified or attained so as to have less space, whereby the handling of the stationary plate and the connection terminal is facilitated. Furthermore, since the connection terminal itself is secured to the stationary plate, work for connection to and disconnection from the connection terminal and work for routing or securing wires can be carried out easily.

In the above-mentioned induction heating apparatus in accordance with another aspect of the present invention, since a cover for stationary plate having electrical insulation and covering the electrostatic shield is provided on the opposite side of the stationary plate, the exposed parts of the electrostatic shield can be reduced; in the case that the electrostatic shield is connected to a live part directly or via an impedance, electric shock owing to inadvertent contact therewith when the top plate is broken or under repair can be prevented, or in the case that other conductive components are disposed therearound, dielectric breakdown between these components and the electrostatic shield hardly occurs.

In the above-mentioned induction heating apparatus in accordance with another aspect of the present invention, since the cover for stationary plate is firmly secured to the stationary plate so as to cover part or whole of the electrostatic shield and the connection portions, the portions, securely connected to the electrostatic shield, in the connection portions are held between the stationary plate and the cover for stationary plate, whereby the secure connection or the securing of the electrostatic shield is reinforced further firmly, and breakage and peeling owing to bending, vibration, etc. hardly occur. Furthermore, since the stationary plate and the cover for stationary are integrated, the handling is facilitated.

In the above-mentioned induction heating apparatus in accordance with another aspect of the present invention, since an insulator in a half-cured state is used for at least one of the stationary plate and the cover for stationary plate, and heated and cured after assembly to attain integration, the stationary plate and the cover for stationary plate, between which the connection portions are held, can be integrated easily by pressure application while being heated, and the effect of reinforcing the electrostatic shield or the secure connection portions can be enhanced.

In the above-mentioned induction heating apparatus in accordance with another aspect of the present invention, since raw mica is used for at least one of the stationary plate and the cover for stationary plate, and heated after assembly to attain integration, the cover for stationary and the stationary plate can be integrated easily, and the heat resistance of the cover for stationary can be raised. Furthermore, their thicknesses can be reduced.

In the above-mentioned induction heating apparatus in accordance with another aspect of the present invention, since inorganic fiber containing an adhesive is used for at least one of the stationary plate and the cover for stationary plate, and heated after assembly to attain integration, the cover for stationary and the stationary plate can be integrated easily, and their heat resistance can be raised.

In the above-mentioned induction heating apparatus in accordance with another aspect of the present invention, since the connection portion is provided close to the winding on the low-potential side, instead of the winding on the high-potential side, of the induction heating coil, with reference to the potential to which the electrostatic shield is connected, even in the case that the connection portion has an exposed part or is covered with an insulator but the covering is damaged, dielectric breakdown, such as sparking, owing to a high potential difference from the potential of the induction heating coil positioned close thereto, hardly occurs, whereby malfunctions and the like in the drive circuit is prevented from occurring and reliability is enhanced.

In the above-mentioned induction heating apparatus in accordance with another aspect of the present invention, since part of the connection terminal is bent and the connection terminal is secured to the stationary plate, the connection terminal can be installed stably without taking much space.

In the above-mentioned induction heating apparatus in accordance with another aspect of the present invention, since the connection terminal is securely connected to the electrostatic shield using a conductive adhesive, the electrical connection between the connection portion and the connection terminal can be made stable.

In the above-mentioned induction heating apparatus in accordance with another aspect of the present invention, since the connection terminal is retained in the induction heating coil base for supporting the induction heating coil, the connection terminal can be installed stably.

In the above-mentioned induction heating apparatus in accordance with another aspect of the present invention, since a slit portion is provided at least at one position of the stationary plate from its external circumference, the stationary plate or the cover for stationary plate can be prevented from being deformed by the heat received from the matter to be heated or the induction heating coil.

In the above-mentioned induction heating apparatus in accordance with another aspect of the present invention, since a slit portion is provided at least at one position of the cover for stationary plate from its external circumference, the stationary plate or the cover for stationary plate can be prevented from being deformed by the heat received from the matter to be heated or the induction heating coil.

In the above-mentioned induction heating apparatus in accordance with another aspect of the present invention, the connection terminal is secured to the stationary plate with a crimping member and electrically connected to the electrostatic shield. The thermal expansion coefficient of the stationary plate or the electrostatic shield generally differs from the thermal expansion coefficient of the connection terminal. When the stationary plate and/or the electrostatic shield expand and contract repeatedly owing to temperature change during a long-term use, cracks may occur at the connection portion between the electrostatic shield and the connection terminal or improper conduction may be caused at the connection portion, owing to mechanical stress. In the induction heating apparatus in accordance with the present invention, since the connection between the electrostatic shield and the connection terminal is secured with the crimping member (for example, a grommet), the crimping member maintains proper conduction therebetween while playing a role of relieving mechanical stress, thereby preventing occrrence of cracks of improper conduction.

As described above, the present invention can achieve an induction heating apparatus capable of improving the reliability in the electrical connection between the electrostatic shield and the low-potential portion of the inverter circuit thereof and securely suppressing leak current at the time when the user makes contact with a matter to be heated.

Embodiments specifically indicating best modes for embodying the present invention will be elucidated referring to the drawings.

Embodiment 1

Figure 1:
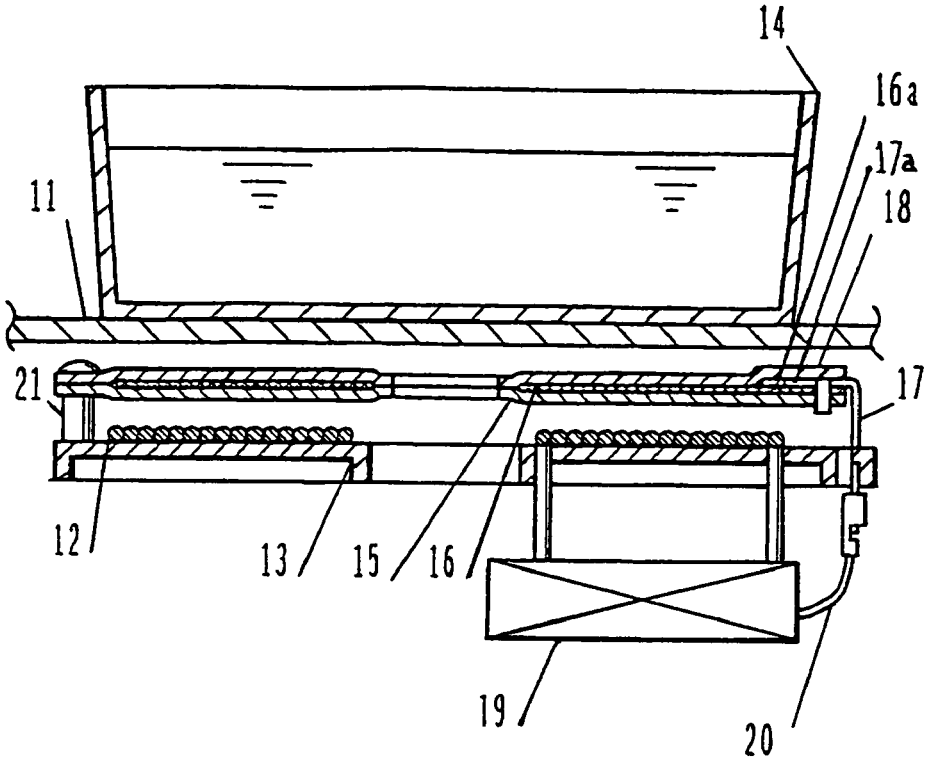
FIG. 1 is a cross-sectional view showing the configuration of the main section of an induction heating apparatus in accordance with Embodiment 1 of the present invention.

The general outline of an induction heating apparatus in accordance with Embodiment 1 of the present invention will be elucidated. In FIG. 1, numeral 11 designates a top plate provided in the upper portion of the main body (not shown) forming an outer shell, and numeral 12 designates an induction heating coil placed on an induction heating coil base 13. Numeral 14 designates a matter to be heated, such as a pan, which is heated by induction heating, and numeral 15 designates a stationary plate made of an inorganic insulator, such as mica. Numeral 16 designates an electrostatic shield made of a mixture of an adhesive and conductive paint containing carbon or the like and applied onto the stationary plate 15, the electrostatic shield comprising a conductive pattern which covers the entire area of the induction heating coil 12 so that the high voltage of the induction heating coil 12 is not induced in the matter 14 to be heated, and connection portions 16*a* provided at both ends of this conductive pattern.

Numeral 17 designates a connection terminal made of brass, and the connection portion 17*a* at its end is opposed to the connection portion 16*a* of the electrostatic shield 16 and securely connected thereto with a conductive adhesive or the like. Numeral 18 designates a cover for stationary plate made of an inorganic insulator, such as mica, covering the electrostatic shield 16, its connection portions 16*a* and the connection portions 17*a* of the connection terminals 17.

Numeral 19 designates drive circuit, such as an inverter circuit, provided below the induction heating coil 12 to supply a high-frequency current to the induction heating coil 12. The electrostatic shield 16 is connected to a predetermined potential, which is relatively low and at which an electrostatic shielding effect is produced by the connection of the electrostatic shield, for example, a DC power supply potential input from this drive circuit 19 via lead wires 20 or a potential lower than that of the high potential portion of the induction heating coil. The connection is carried out directly or via an appropriate impedance element, such as a capacitor or a resistor, depending on the circumstances. The stationary plate 15 and the cover for stationary plate 18 are installed on the bosses 21 of the induction heating coil base 13 using screws.

Next, the configurations of the stationary plate 15, the electrostatic shield 16, the connection terminals 17 and the cover for stationary plate 18 will be elucidated using FIG. 2. Part (a) of FIG. 2 is a perspective view showing the shape of the cover for stationary plate 18, and part (b) of FIG. 2 is a perspective view showing the configurations of the stationary plate 15, the electrostatic shield 16, the connection terminals 17 and the cover for stationary plate 18.

As shown in part (a) of FIG. 2, the cover for stationary plate 18 has an opening 22 in its central portion so that a temperature sensor (not shown) making contact with the bottom face of the top plate 11 and detecting its temperature is disposed. In addition, the cover for stationary plate 18 is provided with installation holes 23 for installation on the main body and a slit portion 24. Furthermore, the cover for stationary plate 18 is provided with protrusion portions 25 for covering the upper faces of the connection terminals.

The stationary plate 15 is provided with an opening 26 and installation holes 27, respectively corresponding to those of the cover for stationary plate 18, and the electrostatic shield 16 is provided between this opening 26 and these installation holes 27. This electrostatic shield 16 has a planar C-shape, covers the entire area of the induction heating coil 12 and is provided with the connection portions 16*a* at both ends of the C-shape. The connection portions 16*a* are connected to the connection portions 17*a* of the connection terminals 17. The connection between the connection portion 16*a* and the connection portion 17*a* is carried out using a conductive adhesive. By this connection, the connection terminals 17 are firmly secured to the stationary plate 15.

At this time, the use of a mixture of an adhesive and conductive powder, such as carbon, the same matter as that of the electrostatic shield 16, is effective in improvement of electrical connection and productivity.

For the configuration of installing the connection terminals 17 to the stationary plate 15, the above-mentioned adhesive may be used with mechanical connection. For example, such a configuration as shown in part (b) of FIG. 2 may be used for securing, wherein the stationary plate 15 is provided with holding portions 28 each having a width corresponding to that of the connection terminal 17, and the connection terminals 17 are each provided with pawl portions 29 adapted to the holding portion 28; furthermore, the connection terminals 17 are bonded to the stationary plate 15 and the pawl portions 29 are bent to embrace the holding portions 28 at the same time.

In this embodiment, the connection terminals 17 are each provided with recess portions 30 so that they can be secured to the induction heating coil base 13. Furthermore, numeral 31 designates a slit portion provided in the stationary plate 15 and provided between both the connection terminals 17.

After the connection terminals 17 are installed to the stationary plate 15, the stationary plate 15 and the cover for stationary plate 18 are overlaid so that the installation holes 27 of the stationary plate 15 are aligned with the installation holes 23 of the cover for stationary plate 18, and then they are heated, whereby they are firmly secured and integrated. This integration is attained by pressurizing and heating an adhesive component included in the electrostatic shield 16 and an adhesive applied to part of at least one of the stationary plate 15 and the cover for stationary plate 18.

At this time, the cover for stationary plate 18 is bonded to the stationary plate 15 while the protrusion portions 25 of the cover for stationary plate 18 cover the connection portions 17*a* of the connection terminals 17, whereby the bonding strength and insulation between the connection terminals 17 and the connection portions 16*a* of the electrostatic shield 16 can be improved.

In this embodiment, the internal side of the induction heating coil 12 is a high-potential side, and the external side is a low-potential side; hence, the distance between the high-potential winding portion of the induction heating coil 12 and the connection terminals 17 is made larger so that dielectric breakdown, such as sparking, hardly occurs, whereby malfunctions and the like in the drive circuit 19 are prevented from occurring and reliability can be enhanced further.

As the bonding method being used at the time when the cover for stationary plate 18 is installed to the stationary plate 15, a method wherein raw mica in which a silicone-based adhesive remains is used for the stationary plate 15 and the cover for stationary plate 18, and the adhesive remaining in the raw mica reacts and is cured to integrate the stationary plate 15 and the cover for stationary plate 18 is also used.

At this time, if an adhesive similar to that used for the bonding of the raw mica is used as the adhesive to connect the connection portions 16*a* of the electrostatic shield 16 to the connection portions 17*a* of the connection terminals 17, the adhesives are blended in well because of their similarity, whereby not only the bonding between the connection portions 16*a* and the connection portions 17*a* but also the bonding between the stationary plate 15 and the connection terminals 17 becomes stronger.

The case wherein raw mica is used for the stationary plate 15 and the cover for stationary plate 18 is described above; however, the bonding method is not limited to this, even if raw mica is used for one of the stationary plate 15 and the cover for stationary plate 18, practically problem-free bonding can be attained although the force of bonding is low in comparison with the case wherein the raw mica is used for both. This method wherein the raw mica is used for at least one of the stationary plate 15 and the cover for stationary plate 18 as described above has a practical effect of omitting an adhesive application process.

In addition to the methods described above, another method is used wherein an insulator in a half-cured state is used for one of the stationary plate 15 and the cover for stationary plate 18, and heated and cured after their overlaying so that they can be integrated. As this kind of insulator, inorganic fiber or inorganic powder formed of silicate or the like or heat-resistant fiber formed of polyamide-imide or the like, impregnated with a glass-based adhesive or a silicone-based adhesive, half-cured and being in a film or sheet state is available.

The stationary plate 15 and the cover for stationary plate 18 tend to be thermally expanded or deformed by the heat received from the matter 14 to be heated, such as a pan, and the induction heating coil 12; however, the thermal expansion is absorbed by the slit portion 24 provided in the cover for stationary plate 18 and by the slit portion 31 provided in the stationary plate 15, whereby the deformation can be suppressed.

Since the slit portion 24 is provided between both the connection terminals 17, the electrostatic shield 16 can be maintained in the C-shape. Furthermore, the case wherein such a slit portion is provided in both the stationary plate 15 and the cover for stationary plate 18 is shown in FIG. 2; however, it may be provided in one of them.

The case wherein the slit portion is provided at one position is shown in FIG. 2; however, its position is not limited to this, it may be provided at a plurality of positions as a matter of course. In this case, however, if the slit portions are formed across the range from the external circumference to the opening, the stationary plate 15 or the cover for stationary plate 18 is divided into a plurality of pieces by slit portions; this is not desirable. Since actual deformation is significant at the external circumference, the slit portions should only be provided in the vicinities of the external circumference, and for practical purposes, the slit portions extended to an intermediate position between the external circumference and the opening are sufficient in length.

The electrostatic shield 16 is formed into a C-shape, the connection terminals 17 are provided in the vicinities of both ends thereof, and the resistance between the connection terminals 17 is measured, whereby the judgment about electrical characteristics, for example, whether or not wires are disconnected and whether or not the electrostatic shield 16 is a normal product having a proper resistance value, can be made easily.

FIGS. 3*a* and 3*b* are cross-sectional views showing in respective directions the main section of a configuration wherein the connection terminal 17 is installed to the induction heating coil base 13; the installation is done by fitting the ribs 32 provided on the induction heating coil base 13 into the recess portions 30 of the connection terminal 17. By this fitting of the connection terminal 17 to the ribs 32, when a Faston terminal is used for the connection between the connection terminal 17 and the lead wire 20 and when the Faston terminal is inserted/removed, the force acting between the connection terminal 17 and the connection portion 16*a* is received by the ribs 32, and the connection between the connection terminal 17 and the connection portion 16*a* is not detached, whereby the reliability of the electrical connection can be improved.

In the connection between the electrostatic shield 16 and each of the lead wires 20, even if the lead wire 20 is directly connected at the connection portion 16*a* using an conductive adhesive and this connection part is held between the stationary plate 15 and the cover for stationary plate 18 as shown in FIG. 5, it is possible to obtain an effect almost similar to that in the case that the above-mentioned connection terminal is used.

When a lower cover for stationary plate 33 is bonded to the rear of the connection terminal 17 as shown in FIG. 4, the live parts of the pawl portions 29 of the connection portion 17*a* can be prevented from being exposed, whereby the insulation of the connection terminal 17 can be improved.

In this embodiment, the electrostatic shield 16 is formed into a C-shape, and the connection terminals 17 are provided in the vicinities of both ends thereof; however, the number of the connection terminals 17 may be one or more, and briefly speaking, the number does not matter so long as the electrostatic shield 16 of the stationary plate 15 and the drive circuit 19 can be electrically connected via the connection terminals 17.

It is described that the electrostatic shield 16 is made of a material mainly consisting of carbon; however, other conductive materials, such as tin oxide, may also be used.

As described above, in this embodiment, the stationary plate 15 having electrical insulation is provided between the top plate 11 and the induction heating coil 12, and the stationary plate 15 is provided with the electrostatic shield 16 and the connection portions 17*a* for connecting the connection wires (in the case that the connection is carried out via capacitors, the connection wires from the capacitors) from the low-potential portion of the drive circuit 19 to the electrostatic shield 16 (including the connection portions 16*a*); hence, with this configuration, production is facilitated and the effect of the high temperature of the matter 14 to be heated on the electrostatic shield 16 is relieved, in comparison with the conventional method wherein the electrostatic shield and the connection portions are formed on the rear face of the top plate 11. In addition, work for electrically connecting both securely is also facilitated. Furthermore, since the connection portions 17*a* are not integrated with the top plate 11, work for assembling the main body of the apparatus is also facilitated.

Since the connection portion 17*a* is integrated (electrically connected) with the connection terminal 17 being used for connection and disconnection of the connection wire, work for the connection and disconnection between the electrostatic shield 16 and the low-potential portion of the driving means 19 can be carried out via the connection terminals 17 easily and securely.

In this embodiment, as the connection portion, the connection portion 17*a* is integrated with the connection terminal 17 and securely connected to the electrostatic shield 16 using an adhesive; however, as another example, as shown in FIG. 5, a configuration wherein the connection portion 17*a* is used as one end of the lead wire 20, made contact with the electrostatic shield 16 (integrated with the connection portion 16*a*) and mechanically pressure-welded, held and secured to attain electrical connection, and the other end of the lead wire is provided with a connection terminal (not shown) can also produce a similar effect. Even in this case, the reliability of the connection is raised further by including a conductive adhesive at the contact part.

Since the connection terminal 17 is configured so as to be secured to the stationary plate 15, the configuration for playing two roles, that is, the stable connection of the connection terminal 17 to the electrostatic shield 16 and the facilitation of the connection and disconnection between the connection terminal 17 and the drive circuit 19, is simplified or attained so as to have less space, whereby the handling of the stationary plate 15 and the connection terminal 17 is facilitated. Furthermore, since the connection terminal 17 itself is secured to the stationary plate 15, work for connection to and disconnection from the driving means 20 and work for routing or securing wires can be carried out easily.

Since the cover for stationary plate 18 having electrical insulation and covering the electrostatic shield 16 is provided on the opposite side (the upper side in this case) of the stationary plate 15, the exposed parts of the electrostatic shield 16 can be reduced; in the case that the electrostatic shield 16 is connected to the live part of the drive circuit 19 directly or via an impedance, electric shock owing to inadvertent contact therewith when the top plate 11 is broken or under repair can be prevented, or in the case that other conductive components are disposed therearound, dielectric breakdown between these components and the electrostatic shield can be prevented.

Since it is configured that at least the secure connection parts for securely connecting the electrostatic shield 16 to parts (the connection portions 17*a*) of the connection terminals 17 and the electrostatic shield in the vicinities thereof are covered and firmly secured to the stationary plate, the portions (the connection portions 17*a*) of the connection terminals 17, securely connected to the electrostatic shield, are held between the stationary plate 15 and the cover for stationary plate 18, whereby the secure connection or the securing of the electrostatic shield 16 is reinforced further firmly, and breakage and peeling owing to bending, vibration, etc. hardly occur. Furthermore, since the stationary plate 15 and the cover for stationary plate 18 are integrated, the handling is facilitated.

Since an insulator in a half-cured state is used for at least one of the stationary plate 15 and the cover for stationary plate 18, and heated and cured after assembly to attain integration, the stationary plate 15 and the cover for stationary plate 18, between which the connection parts are held, can be integrated easily by pressure application while being heated, and the effect of reinforcing the electrostatic shield 16 or the connection portions 17*a* can be enhanced.

Since raw mica is used for at least one of the stationary plate 15 and the cover for stationary plate 18, and heated after assembly to attain integration, the cover for stationary plate 18 and the stationary plate 15 can be integrated easily, and the heat resistance of these can be raised. Furthermore, their thicknesses can be reduced.

Since inorganic fiber containing an adhesive is used for at least one of the stationary plate 15 and the cover for stationary plate 18, and heated after assembly to attain integration, the cover for stationary plate 18 and the stationary plate 15 can be integrated easily, and their heat resistance can be raised.

Since the connection portion 17*a* or the connection terminal 17 is provided close to the winding on the low-potential side, instead of the winding on the high-potential side of the induction heating coil 12, with reference to the potential to which the electrostatic shield 16 is connected, even in the case that the connection portion 17*a* or the connection terminal 17 has an exposed part or is covered with an insulator but the covering is damaged, dielectric breakdown, such as sparking, owing to a high potential difference from the potential of the induction heating coil 12 positioned close thereto, hardly occurs, whereby malfunctions and the like in the drive circuit 19 are prevented from occurring and reliability is enhanced.

Since part of the connection terminal 17 is bent and the connection terminal 17 is secured to the stationary plate 15, the connection terminal 17 can be installed stably without taking much space.

Since the connection terminal 17 is securely connected to the electrostatic shield 16 using a conductive adhesive, the electrical connection between the connection portion 16*a* of the electrostatic shield 16 and the connection portion 17*a* of the connection terminal 17 can be made stable.

Since the connection terminal 17 is retained in the induction heating coil base 13 for supporting the induction heating coil 12, the connection terminal 17 can be installed stably.

Since the slit portion is provided at least at one position on the stationary plate 15 from its external circumference, the stationary plate 15 or the cover for stationary plate 18 can be prevented from being deformed by the heat received from the matter 14 to be heated or the induction heating coil 12.

Since the slit portion 24 is provided at least at one position on the cover for stationary plate 18 from its external circumference, the stationary plate 15 or the cover for stationary plate 18 can be prevented from being deformed by the heat received from the matter 14 to be heated or the induction heating coil 12.

Embodiment 2

An induction heating apparatus in accordance with Embodiment 2 of the present invention will be elucidated using FIGS. 6 to 8. In the induction heating apparatus in accordance with Embodiment 2, the method for securing the connection terminal 17 to the stationary plate 15 and the electrostatic shield 16 differs from that of Embodiment 1. In other points, the induction heating apparatus in accordance with Embodiment 2 is almost the same as that in accordance with Embodiment 1. The method for securing the connection terminal 17 to the stationary plate 15 and the electrostatic shield 16 in the induction heating apparatus in accordance with Embodiment 2 will be elucidatedd. In the induction heating apparatus in accordance with Embodiment 2, FIG. 6 is a magnified perspective view showing the main section in the vicinity of the connection portion of the connection terminal 17, viewed from the side of the top plate 11. FIG. 7 is a magnified perspective view showing the main section in the vicinity of the connection portion of the connection terminal 17, viewed from the side of the induction heating coil 12. FIG. 8 is a cross-sectional view showing the main section in the vicinity of the connection portion of the connection terminal 17.

Two cut portions 41 are provided in the stationary plate 15, whereby a holding portion 28 is formed between the cut portions 41. A grommet 40 (a securing member) holds the connection terminal 17, the stationary plate 15 and the electrostatic shield 16 to secure them integrally and to maintain electrical conduction between the connection terminal 17 and the electrostatic shield 16. The connection terminal 17 has pawl portions 29 and wing portions 17*b* and 17*c*. The pawl portions 29 are bent to embrace the holding portion 28. When a force for bending the connection terminal 17 inward is applied, the wing portion 17*b* is used for support on both sides of the cut portions 41 so that the connection terminal 17 and the holding portion 28 are not bent. When a force for bending the connection terminal 17 outward is applied, the wing portion 17*c* is used for support so that the connection terminal 17 and the holding portion 28 are not bent easily. The wing portion 17*c* makes contact with the electrostatic shield 16 over a wide area and ensures secure electrical conduction between the connection terminal 17 and the electrostatic shield 16.

The thermal expansion coefficient of the stationary plate 15 or the electrostatic shield 16 generally differs from the thermal expansion coefficient of the connection terminal 17. When the stationary plate 15 and/or the electrostatic shield 16 expand and contract repeatedly owing to temperature change during a long-term use, cracks may occur at the connection part between the electrostatic shield 16 and the connection terminal 17 or improper conduction may be caused at the connection portion, owing to mechanical stress. In Embodiment 2, the grommet 40 is used to secure the stationary plate 15, the electrostatic shield 16 and the connection terminal 17. Although the grommet 40 firmly secures the stationary plate 15 and the connection terminal

17 in the thickness direction of the stationary plate 15, slight sliding is allowed among the stationary plate 15, the electrostatic shield 16 and the connection terminal 17 in a direction parallel to the surface of the stationary plate 15. The grommet 40 prevents cracks and improper conduction from occurring while playing a role of relieving mechanical stress owing to temperature change. With this configuration, proper conduction between the electrostatic shield 16 and the connection terminal 17 is ensured for a long period of time.

Even if cracks occur in the electrostatic shield 16 in the vicinity of the grommet 40, the grommet 40 holds down the cracks, and the grommet 40 and the wing portion 17*c* ensure conduction between the connection terminal 17 and the electrostatic shield 16, whereby no problem occurs in the operation of the induction heating apparatus.

When the lower cover for stationary plate 33 is bonded to the rear of the connection terminal 17, the live parts of the grommet 40 and the pawl portions 29 of the connection portion 17*a* can be prevented from being exposed, whereby the insulation of the connection terminal 17 can be improved.

Securing between the stationary plate 15 and the connection terminal 17 may be carried out using a crimping member other than the grommet.

Since the holding portion 28 is not protruded from the stationary plate 15 in Embodiment 2, the cover for stationary plate 18 has no protrusion portions 25.

As in Embodiment 1, the connection terminal 17 is retained to the induction heating coil base 13.

As described above, the present invention can achieve an induction heating apparatus capable of improving reliability in the electrical connection between the electrostatic shield and the low-potential portion of the inverter circuit thereof and securely suppressing leak current at the time when the user makes contact with a matter to be heated.

INDUSTRIAL APPLICABILITY

The induction heating apparatus in accordance with the present invention is useful for cooking apparatuses and the like.

The invention claimed is:

1. An induction heating apparatus comprising an induction heating coil for induction heating a matter to be heated, a top plate provided between said matter to be heated and said heating coil, driving means for supplying a high-frequency current to said induction heating coil, and an electrostatic shield having conductivity, provided between said top plate and said induction heating coil and connected to a low-potential portion, wherein a stationary plate having electrical insulation is provided between said top plate and said induction heating coil, said stationary plate is provided with said electrostatic shield and connection portions connected to said electrostatic shield, and said electrostatic shield is connected to said low-potential portion via said connection portions, wherein a cover for stationary plate having electrical insulation and covering said electrostatic shield is provided on the opposite side of said stationary plate, and wherein raw mica containing an adhesive is used for at least one of said stationary plate and said cover for stationary plate, and heated after assembly to attain integration.

* * * * *